United States Patent [19]

Howes

[11] Patent Number: 5,076,433

[45] Date of Patent: Dec. 31, 1991

[54] PRIZE DELIVERY SYSTEM

[76] Inventor: James P. Howes, 33 Cedar Rd., Wilton, Conn. 06897

[21] Appl. No.: 632,548

[22] Filed: Dec. 24, 1990

[51] Int. Cl.[5] ..... B65D 3/28

[52] U.S. Cl. ..... 206/459; 229/1.5 B; 206/217; 206/232

[58] Field of Search ..... 206/459, 831, 217, 232; 229/1.5 B

[56] References Cited

U.S. PATENT DOCUMENTS

| | | | |
|---|---|---|---|
| 1,657,391 | 1/1928 | Haney | 206/831 X |
| 1,711,469 | 4/1929 | Stratford | 206/831 X |
| 2,041,170 | 5/1936 | Dorsey | 206/831 X |
| 3,850,361 | 11/1974 | Day et al. | 206/831 X |
| 4,729,477 | 3/1988 | Growney | 206/831 X |
| 4,838,424 | 6/1989 | Petzelt | 206/831 X |
| 5,007,578 | 4/1991 | Simone | 206/831 X |

*Primary Examiner*—William I. Price
*Attorney, Agent, or Firm*—Melvin I. Stoltz

[57] ABSTRACT

In the present invention, food product containers, holders, wrappers or instruments are constructed in a manner which enables these products to secretly retain a prize award, while being indistinguishable from non-prize bearing products. In this way, the prize-bearing product may be randomly distributed with conventional, non-prize bearing products, without having the existence of a prize award being discovered before opening by the consumer. By creating a prize retaining zone which is secretly and undiscoverably embedded in conventional food delivery products such as cups, straws, holders, containers, etc., prize awards such as cash, are secretly hidden and randomly distributed to lucky customers who instantly win the prize award.

5 Claims, 2 Drawing Sheets

PRIZE DELIVERY SYSTEM

BACKGROUND ART

The use of various promotional enhancements for increasing the sales of particular products is commonly employed by manufacturers or distributors for a wide variety of products. These promotional enhancements take on a variety of forms, all for the purpose of increasing product sales.

One of the promotional methods often employed by manufacturers of products is to include a prize in either every product container or in selected containers. Although this promotional method has been successful with companies who distribute products, promotional concepts of this nature have been incapable of being employed in the sale or distribution of products which are placed in the container at the time of sale. Products of this nature are typically food products, such as beverages, ice cream, pop corn and fast foods which are wrapped or placed in containers at the time of purchase.

In order to attain greater market share and sales increases in the food service industry, various promotional techniques have been developed. Typically, contests are conducted in which coupons are given out to customers in an attempt to increase overall product sales and attract customers to patronize the food distribution outlet or chain. In addition, in order to promote certain product sales, promotional contests or games have been employed which focus on a particular product, such as a beverage purchases, wherein labels are affixed to the outside surface of drinking cups.

In order to achieve greater market share and/or product sales, various entities in the food service industry have attempted to find increasingly unique promotional techniques which generate added sales for their particular products. In doing so, the premium or prize type promotions have progressed from inexpensive give-aways, which are handed out to customers with any purchase, to expensive prize awards which are won by collecting numerous components of a final multi-part coupon or ticket. In this way, numerous repeated visits to the food provider are required before any individual would be able to win a valuable prize.

Recently, a unique marketing approach was developed wherein actual cash awards are secretly retained in food product containers for wet or moist products such as soda, water, beer, milk, yogurt and the like. This invention is disclosed in U.S. Pat. 4,911,321. A nationwide promotion was conducted employing the teaching of this patent, which produced overwhelming consumer excitement and commercial success.

Prior to the present invention, however, the food service industry was incapable of enjoying the substantial commercial success realized by employing the invention disclosed in U.S. Pat. No. 4,911,321, due to the on-site delivery of food products in holders or containers as opposed to pre-packaged containers, upon which the constructions detailed in U.S. Pat. No. 4,911,321 are based. As a result of this inability, the food service industry has been unable to enjoy the commercial success obtainable from employing an overwhelmingly effective and highly successful product sales incentive which generates substantial interest, customer identification and increased purchases.

Consequently, it is a principal object of the present invention to provide a prize delivery system for use in the food service industry in connection with the sale of any desired food products, particularly food products prepared and delivered on site.

Another object of the present invention is to provide a prize delivery system having the characteristic features described above which comprises a container, holder or instrument for use with food products which is identical in all respects to typical product containers, holders or instruments, but which secretly contains a hidden prize award.

Another object of the present invention is to provide a prize delivery system having the characteristic features described above wherein the prize bearing container, holder or instrument is completely indistinguishable from non-prize bearing containers, holders, or instruments, thereby preventing advance discovery of the existence of a prize award contained therein.

Another object of the present invention is to provide a prize delivery system having the characteristic features described above wherein the prize bearing container, holder or instrument is indistinguishable from non-prize bearing containers, holders, and instruments such that both can be distributed to retail outlets with complete assurance that the prize bearing containers, holders or instruments cannot be detected when compared to non-prize bearing containers, holders or instruments.

A further object of the present invention is to provide a prize delivery system having the characteristic features described above which enables a highly effective promotional technique to be employed in the food service industry for substantially increasing sales while directly rewarding the purchasing public with prize awards that are completely randomly distributed.

Other and more specific objects will in part be obvious and will in part appear hereinafter.

SUMMARY OF THE INVENTION

By employing the present invention, the failure of the prior art to enable highly successful prize incentives or premium promotions to be used in the food service industry is completely overcome. In the present invention, food product containers, holders or instruments normally employed in delivering the desired food products for consumption are specially constructed to secretly retain a prize award, while being completely indistinguishable from non-prize bearing containers, holders or instruments.

By following the instructions provided, the consumer is able to obtain access to the secret prize holding zone and determine whether or not an actual prize has been won. By employing this invention, lucky consumers who find a prize award secretly retained in their food containers, holders or instruments become instantaneous winners, without being required to make numerous repeated visits to the food service outlet or to collect a plurality of coupon portions in the hopes of winning a prize in the future.

Since the prize bearing containers, holders and instruments of this invention are indistinguishable from non-prize bearing containers, holders and instruments, no amount of external analysis by either consumers or employees will be sufficient to enable someone to discover which containers, holders or instruments are actually prize bearing. Consequently, the prize bearing containers, holders or instruments can be randomly distributed with non-prize bearing containers, holders or instruments with complete assurance that a prize bearing container, holder or instrument cannot be purposefully preselected by either a consumer or an employee. Instead, the random distribution of prize bearing containers, holders or instruments with non-prize bearing containers, holders or instruments will assure that winning customers will be completely random and not preselected or purposefully achieved.

By employing the prize delivery system of the present invention, any food related vehicle employed in the food industry can be constructed in a manner to secretly retain a prize award. Preferably, by employing the present invention, cash awards of various denominations are employed as the principal prizes. In this way, a highly effective, consumer-motivating promotion is attained, wherein consumers immediately win the actual monetary award by merely purchasing a food product. The consumer excitement achieved by being a winner and immediately receiving a cash prize causes overwhelming consumer excitement and interest in repeatedly participating in the give-away promotion.

The invention accordingly comprises an article of manufacture possessing the features, properties and the relation of elements which will be exemplified in the articles hereinafter described, and the scope of the invention will be indicated in the claims.

THE DRAWINGS

For a fuller understanding of the nature and objects of the present invention, reference should be had to the following detailed description, taken in connection with the accompanying drawings in which.

DETAILED DESCRIPTION

As is apparent from the following detailed disclosure, the prize delivery system of this invention is effectively usable in connection with any desired food or beverage container, holder, wrapper, instrument, or utensil, employed in the food service industry. In this regard, the present invention is equally applicable to all facets or categories of the food service industry, such as fast food outlets, restaurants, contract feeders, vending outlets, recreational outlets, and the like. In one exemplary instance, the prize delivery system of this invention can be employed in fast food outlets in connection with the sale and distribution of hamburgers, hot dogs, french fries, pancakes, eggs, popcorn, ice cream, soda, coffee, hot chocolate and the like. Furthermore, products commonly distributed in the food service industry but not employed for holding food products could also incorporate the present invention, such as straws, which are distributed to consumers for drinking various beverages.

In the following detailed disclosure, drinking cups, straws, a special game coupon, and food product containers are fully and completely described, as examples of the prize delivery system of the present invention. However, the scope of the present invention is not, in any way, intended to be limited to the specific embodiments, since the present invention is equally applicable to any other holders, containers, wrappers, or utensils employed in the food service industry.

Figure 3:
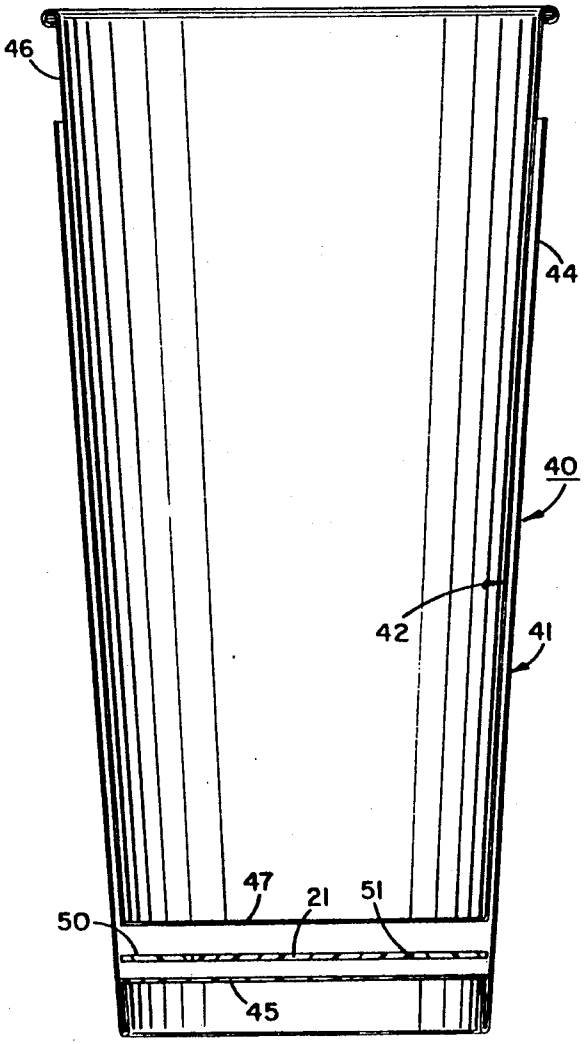
FIG. 3 is a cross-sectional, side elevation view of an alternate embodiment for a food or beverage container.
Figure 2:
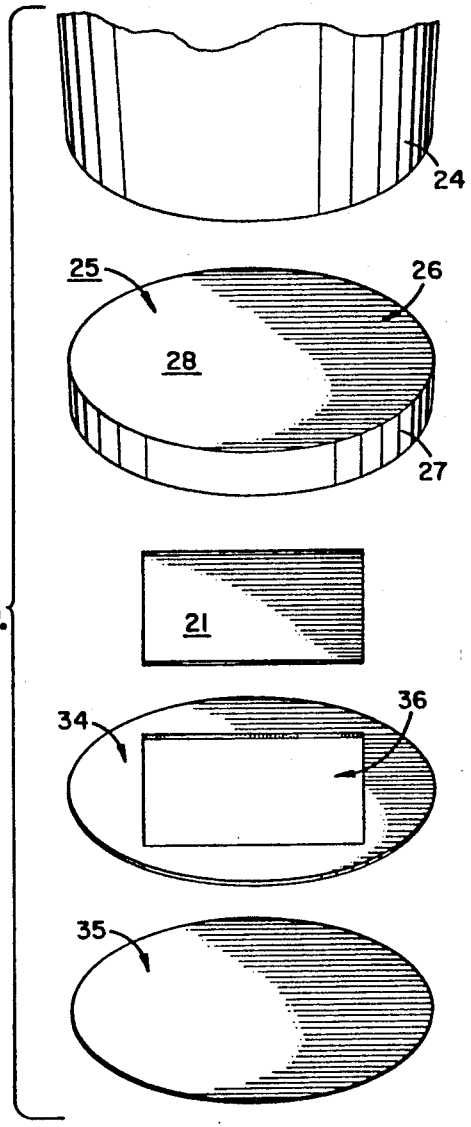
FIG. 2 is an exploded perspective view, partially broken away, of the food or beverage container of FIG. 1.
Figure 1:
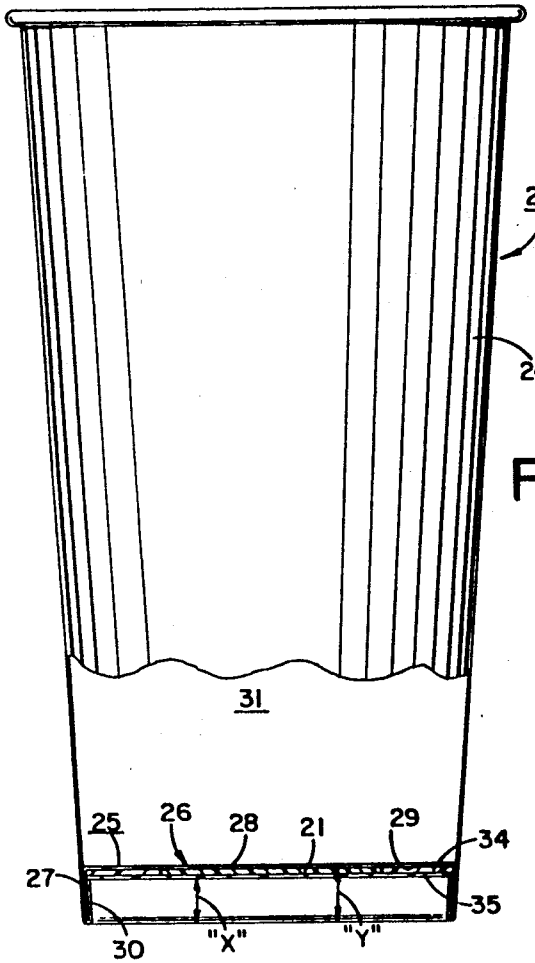
FIG. 1 is a side elevation view, partially broken away, and partially in cross-section showing one embodiment of the prize delivery system of the present invention in the form of a food or beverage container.

In FIGS. 1-3, one embodiment of the prize delivery system of the present invention is depicted in the form of a food or beverage holding cup. As shown therein, cup 20, which may be used for any beverage or food product such as yogurt, french fries, popcorn, ice cream and the like, is constructed to secretly retain prize award 21 in a manner which prevents consumers or employees of the food distributor from being able to distinguish prize bearing cup 20 from conventional non-prize bearing cups. In accordance with this invention, cup 20 is constructed to be completely indistinguishable from non-prize bearing cups, in order to enable prize bearing cup 20 to be randomly distributed with non-prize bearing cups. In this way, complete random distribution of prize award 21 to lucky consumers is assured.

In this embodiment, cup 20 comprises a substantially cylindrically shaped, wall defining member 24 and a base 25. Base 25 comprises a substantially circular shaped central portion 26 and a peripherally surrounding, depending flange 27. In addition, central portion 26 of base 25 comprises an upper surface 28 and a lower surface 29.

Base 25 is securely affixed to cylindrically shaped, wall defining member 24 in the generally conventional manner. In this typical construction, the lower terminating end portion 30 of wall defining member 24 is folded about depending flange 27 of base 25 and sealingly glued thereto, thereby securely affixing base 25 to wall member 24. In this way, an interior food or beverage retaining zone 31 is formed. In addition, upper surface 28 of base 25 is typically constructed, in a manner well known in the art, to incorporate a leak-free construction, thereby assuring the trouble-free retention of the desired food or beverage in retaining zone 31 of cup 20, without incurring any unwanted leakage therefrom.

In order to secretly retain prize award 21 in a manner which is completely undetectable by any individual, prize bearing cup 20 also incorporates a prize award holding plate 34 and a support disk 35. Both prize holding plate 34 and support disk 35 are constructed in a substantially circular shape having a diameter virtually identical to the diameter of central portion 26 of base 25. In addition, in the preferred embodiment, prize holding plate 34 and support disk 35 are securely bonded to each other, to form a single component for purposes of manufacture, thereby enhancing the speed, efficiency, and ease of manufacturing prize award bearing container 20 of this invention.

In the preferred embodiment, prize holding plate 34 incorporates a cut-out zone 36 which is dimensioned for receiving prize award 21. In addition, the thickness of the material employed for manufacturing prize holding plate 34 is also preferably selected to be precisely equivalent to the thickness of prize award 21 when positioned for retention in cut-out zone 36.

In the preferred embodiment, prize award 21 comprises a cash award in the form of currency, preferably ranging between about $1.00 to $500.00 in face value. Although any desired denomination of currency can be employed, it has been found that by providing a cash prize award, consumer excitement over the instantaneous winning of a prize is substantially heightened.

With prize award 21 comprising cash awards of varying denominations, prize holding plate 34 comprises a thickness which is substantially equivalent to the thickness of the currency, when the currency is folded to a size substantially equivalent to the size of cut-out zone 36. In this way, prize award 21 conveniently fits directly within cut-zone 36, substantially filling zone 36, with the resulting thickness formed by prize award 21 being virtually equivalent to the thickness of prize holding plate 34. As a result, a smooth, convenient, uniformly shaped prize retaining package is attained for being secretly stowed in the base of cup 20.

In order to provide cost efficient automated manufacturing of prize retaining cup 20, while also assuring that prize retaining cup 20 is completely indistinguishable from non-prize bearing cups, base 25 and support disk 36 are formed from the identical material. Preferably, a large sheet of material having the desired thickness and surface coating is employed. In addition, the sheet of material is printed with the particular desired graphics or words which have been predesigned for the particular promotion. Then, a plurality of circular shaped disks are cut from the sheet, with each disk incorporating the printed indicia.

Preferably, each substantially circular disk comprises an overall diameter which is equivalent to central portion 26 and flange 27 of base 25. In this way, the preprinted, pre-cut disks are employed for base 25 in the manufacture of both the prize bearing cup and non-prize bearing cups.

In addition, in order to form support disk 35 in a manner which will look identical to central portion 26 of base 25, a plurality of the cut circular disks are trimmed to remove the material which would form flange 27. With that material removed, support disk 35 is produced, which will look visually identical to central portion 26 of base 25. In this way, once support disk 35 has been affixed to the bottom of cup 20, concealing the presence of prize holding plate 34, the resulting construction provides visual identity between prize bearing cup 20 and a non-prize bearing cup.

In order to further enhance the automated manufacture of prize bearing cup 20, prize holding plates 34 are formed in a manner substantially identical to the process detailed above in reference to the pre-printed disk members. In this way, a plurality of prize holding plates 34 are formed from a substantially enlarged sheet which is formed from the desired material with the preferred thickness. During the cutting process, wherein the precisely desired dimension for prize holding plate 34 is cut from the enlarged sheet, cut-out zones 36 are also simultaneously cut. As a result, prize holding plates 34 ar formed quickly and efficiently.

Once prize holding plate 34 and support disk 35 have been formed, these two members are preferably glued together, forming a subassembly. Once formed, the positioning and retention of prize award 21 is quickly and easily attained by merely folding the currency and positioning the folded currency in cut-out zone 36. With the support disk 35 closing one side of cut-out zone 36, the rapid positioning and retention of prize award 21 in cut-out zone 36 is assured.

Once prize award 21 has been positioned in the precisely desired manner in cut-out zone 36 of prize holding plate 34, glue is applied to the top surface of prize holding plate 34, and the entire subassembly is affixed to lower surface 29 of base 25 of cup 20. Once securely affixed in position, prize award 21 is secretly retained in cup 20, in a manner which is completely undetectable from observation and comparison of prize retaining cup 20 with non-prize bearing cups. Furthermore, since support disk 35 comprises the identical material and identical graphics employed on lower surface 29 of base 25, visual identity is assured and comparison of prize retaining cup 20 with non-prize bearing cups reveals no discernible differences.

In the preferred embodiment, one adjustment is made in manufacturing prize retaining cup 20 in order to further enhance the visual indistinguishable construction thereof. Inasmuch as prize holding plate 34 and support disk 35 comprise a fixed overall thickness, cup 20 should be constructed to assure that this added thickness is not discoverable.

As shown in FIG. 1, distance "X" represents the substantially vertical distance between the bottom edge of flange 30 and outer visible surface of disk 35. In nonprize bearing cups, this distance would be between the bottom edge of flange 30 and the lower surface of the cup base.

In order to assure that the visual observation of distance "X" appears identical in both prize bearing cups and non-prize bearing cups, the preferred manufacturing procedure for forming prize bearing cup 20 incorporates the positioning of base 25 with the cylindrical wall defining member 24, in the manner detailed above, at a position which is further away from the bottom edge of terminating end portion 30 than normally employed. As shown in FIG. 1, prize retaining cup 20 is preferably constructed with the distance "Y", forming the vertical distance between lower surface 29 of base 25 and the bottom edge of terminating end portion 30, with distance "Y" being greater than the distance normally found with non-prize bearing cups.

In this construction, the difference between distance "Y" and distance "X" is equal to the thickness of prize holding plate 34 and support disk 35. As a result, once prize holding plate 34 and support disk 35 have been securely affixed to base 25 of cup 20, the distance between the bottom of support disk 35 and the bottom edge of terminating end portion 30 of cup 20 is equivalent to "X", the precise distance normally found in non-prize bearing cups.

In this way, prize bearing cups 20 are visually identical to non-prize bearing cups, and no visual clues exist which would enable someone to conclude that one of the cups retains a prize award. As a result, the precisely desired, secret, completely undetectible, retention of a prize award in cup 20 is assured.

In an alternate construction, the base of each non-prize bearing cup is constructed from material having a greater thickness than base 25 of cup 20. In this alternate embodiment, the thickness of the base of non-prize bearing cups equals the combined thickness of base 25, holding plate 34 and disk 35. In this way, all final dimensions of both prize bearing cups and non-prize bearing cups are identical and no discernible difference exists which would enable someone to advance detect the existence of a prize award in advance of actual opening of the cup.

In the preferred embodiment, prize retaining cup 20 is seeded or intermixed with non-prize retaining cups at a convenient location, such as a manufacturing facility and then distributed in the normal channels of trade. In this way, any retail outlet desiring to benefit from the enhanced commercial sales attainable by employing the prize delivery system of the present invention would merely purchase cups, wherein prize bearing cups are randomly intermixed with non-prize bearing cups.

Preferably, the non-prize bearing cups, as well as the prize bearing cups, will all incorporate identical visual indicia printed on the outer surface of cylindrical wall member 24, which promote the prize delivery system and inform the consumers of the method to use in order to access the prize award holding zone. In this way, all customers purchasing the particular food products would attain visually identical cup constructions, in which the existence of a prize delivery system would be detailed along with instructions on how to determine if a prize has been won.

By employing the present invention, the excitement of winning a prize award is enhanced and shared with all of the customers in the retail outlet at the time a prize award is won. Since any consumer winning a prize award would certainly exude substantial excitement, this excitement will be carried over to the non-prize winners, causing them to be excited and enticed at the prospect of winning the next time, thereby assuring repeat business for the retail outlet.

In FIG. 3, an alternate construction for producing a prize retaining cup is detailed. Prize retaining cup 40 employs a dual or multi-wall cup construction to secretly retain the desired prize award. As shown FIG. 3, prize retaining cup 40 incorporates an outer cup member 41 and an inner cup member 42.

Outer cup member 41 comprises a substantially cylindrically shaped wall portion 44 and a base portion 45 securely affixed to one end of cylindrical wall portion 44 in the conventional manner detailed above. Similarly, inner cup member 42 comprises a substantially cylindrically shaped wall portion 46 and a base portion 47 affixed to one end of cylindrical wall portion 46 in a conventional manner or integrally formed therewith.

In order to secretly retain a prize award in cup 40, a prize holding plate 50 is employed which is constructed substantially identical to prize holding plate 34. In the manner detailed above, prize holding plate 50 incorporates a cut-out zone 51 in which the desired prize award 21 is securely retained.

In assembling prize retaining cup 40, prize holding plate 50, with prize award 21 positioned in cut-out zone 51, is placed on the top surface of base portion 45 of outer cup member 41. Then, inner cup member 42 is telescopically inserted into outer cup member 41, bringing the bottom surface of base portion 47 into overlying concealing engagement with prize holding plate 50. Preferably, prior to telescopically inserting inner cup member 42 into outer cup member 41, the walls of inner cup member 42 will be covered with adhesive in order to assure secure, affixed, retained, interengagement of outer cup member 41 with inner cup member 42. Alternatively, cup members 41 and 42 may be integrally affixed to each other using any desired alternate sealing means.

Once fully assembled, prize award 21 would be completely concealed between base portions 45 and 47, rendering the presence of prize award 21 completely undetectible from a non-prize bearing cup. In this embodiment, in order to assure complete identity of prize retaining cup 40 with non-prize bearing cups, all of the cups during the promotional period are manufactured with the dual-wall construction described above. However, non-prize bearing cups would not incorporate prize holding plate 50 with the desired prize award.

Of course, if desired, a prize holding plate 50 could be employed in all cups with a particular message being used to fill cut-out zone 51, informing the consumer that no award has been won while encouraging the consumer to continue to participate in the prize award game promotion. In this way, all cups would be completely identical and the presence of a prize award in any cup would be incapable of being undetectible.

Figure 4:
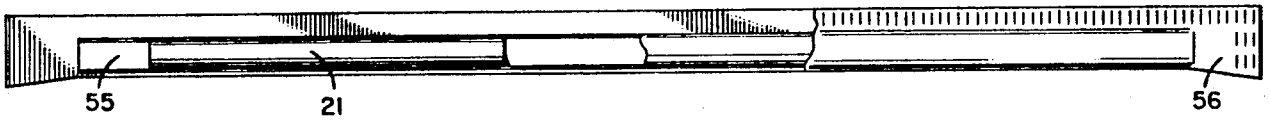
FIG. 4 is a top plan view, partially broken away, and partially in cross-section of an alternate embodiment of the prize delivery system of the present invention in the form of a drinking straw assembly.
Figure 5:
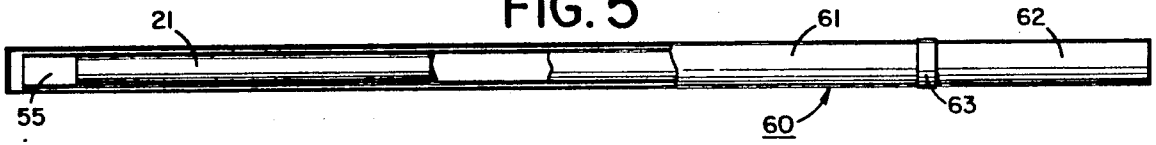
FIG. 5 is a top plan view, partially broken away, and partially in cross-section of an alternate embodiment of a drinking straw assembly in accordance with the present invention.

In FIGS. 4 and 5, two alternate embodiments for the prize delivery system of the present invention are depicted. In these two embodiments, the prize delivery system employs drinking straws as the vehicle in which a prize award is randomly distributed to lucky consumers.

In the embodiment depicted in FIG. 4, a conventional, elongated, cylindrically shaped drinking straw 55 is employed. In specifically desired, pre-selected drinking straws 55, a prize award 21 is inserted. Preferably, prize award 21 comprises a cash currency award of any desired denomination. As detailed above, prize awards ranging between $1.00 and $500.00 bills are preferred.

In this embodiment, the prize award is rolled and inserted into one end of drinking straw 55. Once prize award 21 has been inserted into drinking straw 55, the rolled prize award 21 will unroll, until coming into frictional contact with the inner wall of drinking straw 55, thereby assuring its secure, retained, frictional engagement therewith.

With prize award 21 securely retained in drinking straw 55, drinking straw 55 is enclosed within a suitable covering or wrapper 56. Wrapper 56 comprises a variety of materials such as foil, polymer films or sheets, heavy wrapping paper, or fiber reinforced paper. Regardless of the type of material employed for wrapper 56, wrapper 56 must be sufficiently dense or thick, as well as opaque, so as to prevent anyone from being able to visually or physically examine straw 55 and determine whether or not prize award 21 is contained therein. In this way, assurance is provided that no individual will be able to determine in advance whether a prize award is retained in a straw, prior to be given that particular straw as part of a purchase.

In employing this embodiment, all of the drinking straws to be used during the particular promotion are manufactured in the identical manner, incorporating the identical wrapper 56. As a result, all of the straws employed are visually identical and incapable of being analyzed in advance to determine which straw contains a prize award.

In addition, by employing this prize delivery system, both prize bearing straws and non-prize bearing straws are preferably manufactured simultaneously, with the prize bearing straws being seeded with non-prize bearing straws in a randomly desired fashion, consistent with the desired ratio. As a result, totally random distribution of prize bearing straws are made to the consumers as part of their purchase of a fountain product.

In FIG. 5, another embodiment of the delivery system of the present invention is depicted. In this embodiment, an alternate construction for secretly retaining a prize award in a drinking straw is disclosed.

In this embodiment, drinking straw 55 incorporates a prize award 21, securely mounted therein, as detailed above. However, in order to assure that the presence of prize award 21 in drinking straw 55 is incapable of advance detection, drinking straw 55 is retained within elongated tube 60, which comprises telescopically engageable, mating sections 61 and 62.

In the preferred embodiment, tube 60 comprises a rigid, heavy, opaque material in order to prevent anyone from being able to determine if prize award 21 is present, without separating sections 61 and 62. Preferably, tube 60 comprises cardboard, heavy paper, plastic or the like. However, regardless of the material employed in constructing tube 60, tube 60 must peripherally surround and encase straw 55 in a manner which prevents any individual from being able to determine whether straw 55 incorporates prize award 21. In this way, prize bearing straw 55 in tube 60 is randomly seeded with non-prize bearing straws in similar tubes, and distributed in the normal manner, with lucky customers randomly receiving prize bearing straws 55 in tubes 60.

In the preferred embodiment, in order to preserve the integrity of tube 60 and be certain that no individual, including employees, are capable of investigating the supply of straws to determine which straws contain a prize award, sections 61 and 62 of tube 60 are sealingly interconnected by fastening means 63. Preferably, fastening means 63 peripherally surrounds the entire outer peripheral surface of tube 60, sealingly and integrally interconnecting telescopic sections 61 and 62 together. In this way, dislocation or separation of sections 61 and 62 of tube 60 is prevented.

Furthermore, if any separation of sections 61 and 62 were to occur, the separation would be immediately apparent, since the integrity of fastening means 63 would be destroyed. Consequently, unwanted opening of tube 60 by any individual is prevented and the desired random distribution of prize bearing straws with non-prize bearing straws is assured.

In this embodiment, all of the straws being distributed during the promotional time period would be manufactured in the identical manner. Consequently, all straws being distributed as part of the promotional contest would comprise straws mounted within tubes 60.

In this way, each and every straw is visually identical in appearance, weight, and feel, with no one straw/tube assembly being capable of being analyzed by any individual as the particular straw/tube combination in which a prize award is contained. As a result, the precisely desired random distribution of prize bearing straws with non-prize bearing straws is efficiently attained and all of the features and inherent consumer excitement generated by the prize delivery system of the present invention are realized.

Figure 9:
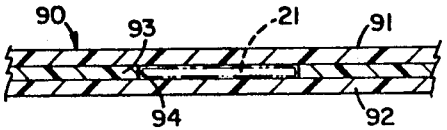
FIG. 9 is a cross-sectional side elevation view, partially broken away, of a conventional food container wall incorporating an alternate embodiment of the prize delivery system of the present invention.
Figure 8:
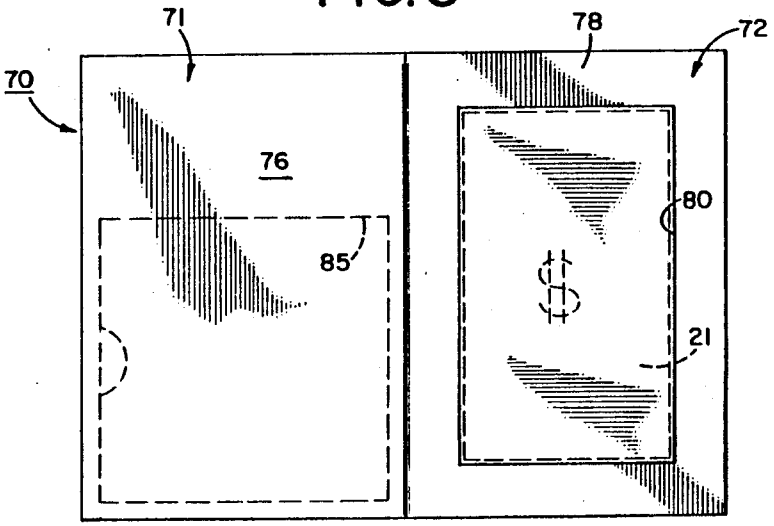
FIG. 8 is a front elevation view showing the assembly of an alternate embodiment of a game card in accordance with the present invention.
Figure 7:
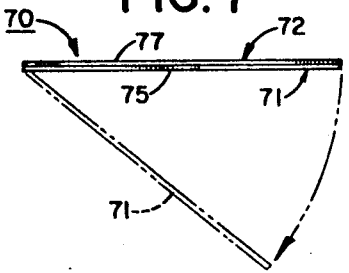
FIG. 7 is a top plan view of the game card of FIG. 6.
Figure 6:
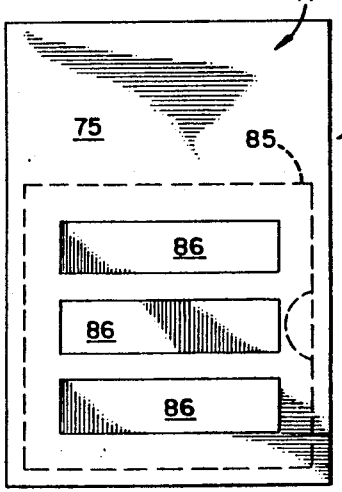
FIG. 6 is a front elevation view of an alternate embodiment of the prize delivery system of the present invention in the form of a game card.

In FIGS. 6–9, final alternate embodiments of the prize delivery system of the present invention are depicted. In FIGS. 6, 7 and 8, the prize delivery system of the present invention is shown in one particular construction in the form of a game coupon or game card distributed with any purchase during the sales enhancement promotion. In FIG. 9, the prize delivery system of this invention is depicted in an alternate construction as the wall of a food container, holder, or wrapper.

Although FIGS. 6–9 depict alternate structures of the prize delivery system of this invention for different end products, it should be apparent from the following detailed disclosure that the construction for the game card embodiment shown in FIGS. 6–8 may be employed with equal efficacy in constructing a food product container, holder or wrapper. Similarly, the construction for the food product container, holder, or wrapper of FIG. 9 may be employed with equal efficacy in constructing a game card.

As a result, FIGS. 6–9 effectively teach two alternate embodiments for manufacturing both game cards and food containers in a manner which enable these products to incorporate therein a prize award, with the existence of the prize award being completely undetectible by any individual, regardless of extensive observation.

In FIGS. 6, 7 and 8, the prize delivery system of the present invention is depicted as comprising a game card, ticket or coupon 70, which incorporates two mating sections 71 and 72. In FIG. 7, game card sections 71 and 72 are depicted as independent components, which are integrally bonded together as detailed herein. Alternatively, as shown in FIG. 8, game card sections 71 and 72 are formed on a single sheet of material and folded to create game card 70.

Regardless of which construction is employed, game card section 71 preferably comprises an outer surface 75, and an inner surface 76. Similarly, game card section 72 comprises an outer facing surface 77 and an inside surface 78.

In addition, in the preferred construction, at least inside surface 78 of section 72 comprises a recess zone 80, dimensioned to comprise an overall area substantially equivalent to the area required for nested receiving engagement of prize award 21 therein. If desired, a similar recess zone is formed in inside surface 76 of section 71.

As detailed above, in the preferred embodiment, prize award 21 comprises a cash award ranging between $1.00 and $500.00. In addition, in this embodiment, in order to attain a game card 70 which is the easiest to produce and provides the thinnest construction, prize award 21, in the form of currency, would merely be folded in half, thereby assuring a thin, overall area to be hidden within the resulting game card. Consequently, recess zone 80 need only to be formed to a depth substantially equivalent to the thickness of typical currency.

In this way, folded currency is easily retained within recess zone 80 without being detected. Clearly, since sections 71 and 72 comprise overall dimensions which are greater than the overall dimension of prize award 21 and prize award 21, is securely retained within mating recess zone 80, anyone observing the edge of the game card 70 is completely incapable of determining whether prize award 21 is secretly retained therein.

In order to complete the construction of game card 70, it is preferred that sections 71 and 72 be securely affixed to each other, thereby preventing unwanted tampering with game card 70 in an attempt to determine if a prize award is present. Although sections 71 and 72 can be securely fastened to each other in a plurality of alternate constructions, it has been found that one simple and inexpensive construction technique is merely to apply glue means to surface 78, peripherally about recess zone 80 of card section 72. Then, after positioning prize award 21 in recess zone 80, section 71 is quickly and easily securely affixed to section 72 by merely abuttingly contacting inside surface 76 with the glue means on inside surface 78 of section 72.

In this way, the final construction of card 70 is quickly and inexpensively attained and prize award 21 is secretly retained in game card 70, completely unable to be detected prior to opening game card 70 in the manner instructed. As shown in FIG. 7, access to prize award 21 is easily attained by merely separating sections 71 and 72.

In implementing this embodiment of the present invention, a great variety of construction and assembly techniques can be employed. However, it is intended that all of these variations are within the scope of the present invention and not patentably distinct therefrom. In this regard, a plurality of alternate arrangements can be employed for obtaining access to prize award 21 by the consumer.

As shown in FIGS. 6 and 8, one alternate technique is to employ a scored zone 85 on section 71 which would enable the consumer, upon receiving card 70, to easily open a panel formed by score lines 85, revealing to the consumer the presence of prize award 21 therein. In order to further heighten the excitement of winning a prize award, covered information zones 86 may also be formed on section 71 of card 70, requiring the consumer to scrape off a concealing film, well known in the art, to reveal a message printed therebelow.

This message could inform the consumer that card 70 secretly retains a cash prize award with instructions on how to obtain access to prize award 21. If desired, scored zone 85 may be used in combination with covered sections 86 as depicted in FIG. 6. Alternatively, these elements can be used separately, or not at all, depending upon the particular card construction desired.

In FIG. 9, an alternate embodiment for the prize delivery system of the present invention is disclosed. In this embodiment, the prize delivery system is depicted as a portion of one wall or panel 90 of a typical food product container, holder, wrapper or utensil.

In this embodiment, the wall panel 90 comprises two layers 91 and 92 which are in overlying, concealing engagement with prize holding substrate 93. Preferably, prize holding substrate 93 is formed in a manner similar to prize holding plates 34 and 50 detailed above, with cut-out zone 89 formed therein.

As depicted in FIG. 9, prize award 21 is securely positioned in cut-out zone 94 of substrate layer 93, thereby being maintained between outer sections 91 and 92, assuring that the presence of prize award 21 is completely undiscoverable, without destroying the entire wall assembly 90.

As previously discussed, the thickness of substrate 93 is substantially equivalent to the thickness attained by folding prize award 21 into the desired shape. Consequently, prize award 21 substantially fills the entire retaining zone 94, thereby assuring that prize award 21 is incapable of being detected by either visual or manual analysis of wall panel 90.

If desired, all containers, holders, instruments, or game cards may be manufactured incorporating intermediate prize holding substrate 93, in order to assure consistency of size, shape and form of all give-aways during the promotional period. Furthermore, if desired, all game cards or packages may be manufactured in a virtually identical manner, with cut-out zone 94 of prize holding substrate 93 incorporating a pre-printed message informing the consumer that no prize award has been won, but encouraging the consumer to continue to participate in the promotional contest. In this way, complete uniformity of all game cards, food containers, holders or instruments is maintained and the secrecy of which product contains the prize award is preserved.

As detailed above in reference to the game cards, outer section 91 and 92 are securely affixed to opposed surfaces of prize holding substrate 93, thereby sandwiching prize holding substrate 93 therebetween, and securely retaining prize award 21 in complete, secrecy. In this way, complete secrecy is maintained until a consumer obtains access to the prize holding zone and discovers the presence of prize award 21.

It will thus be seen that the objects set forth above, among those made apparent from the preceding description, are efficiently attained and, since certain changes may be made in the above articles without departing from the scope of the invention, it is intended that all matter contained in the above descriptions or shown in the accompanying drawings shall be interpreted as illustrative and not in a limiting sense. It is also to be understood that the following claims are intended to cover all of the generic and specific features of the invention herein described and all statements of the scope of the invention in which, as a matter of language, might be said to fall therebetween.

Having described my invention, what I claim is new and desire to secure by Letters Patent is:

1. A prize delivery system incorporated within a food or beverage container typically employed in the food service industry and constructed for secretly retaining a prize award, while visually simulating non-prize bearing containers for preventing advance detection of the existence of prize bearing containers among a plurality of mixed prize bearing containers and non-prize bearing containers, said prize delivery system comprising:

A. an outer surface defining shell
  a. defining an internal retaining zone,
  b. comprising an entry portal at one end thereof, and
  c. a base defining member at the opposed end thereof, establishing the internal retaining zone therebetween;

B. a prize retaining member
  a. affixed to one surface of the base member in overlying, covering engagement therewith, and
  b. comprising means forming a prize retaining zone for receiving a prize award;

c. a prize award mounted in the retaining zone of the prize retaining member for being secretly retained therein until exposed by a consumer, D. a covering plate
  a. positioned in overlying visually obscuring engagement with said prize retaining member and said prize award, preventing visual observation thereof, and
  b. visually simulating a non-prize bearing container, preventing advance detection of the presence of a prize award therein;

whereby a prize delivery system is attained wherein a prize award is secretly concealed in a food or beverage container, with the presence of the prize award being completely undiscoverable when compared with non-prize bearing, conventional food or beverage containers, thereby enabling the random distribution of prize bearing containers with non-prize bearing containers, with complete assurance that the presence of a prize award is discovered by consumers only upon opening of the container assembly.

2. The prize delivery system defined in claim 1, wherein said prize award is further defined as comprising paper currency.

3. The prize delivery system defined in claim 1, wherein said container is further defined as comprising a substantially cylindrically shaped beverage container with the base, thereof and the prize retaining member being substantially circular in shape with substantially equal diameters.

4. The prize delivery system defined in claim 3, wherein said prize retaining member is further defined as comprising an overall thickness substantially equivalent to the thickness of the prize award and said prize retaining zone is further defined as comprising an open zone substantially equivalent in size and shape to the size and shape of the prize award retained therein, whereby the prize award completely fills the prize retaining zone, substantially reducing any likelihood of its early detection.

5. The prize delivery system defined in claim 1, wherein said outer surface defining shell is further defined as comprising graphics printed thereon which are identical in appearance to the graphics employed in conventional, non-prize bearing containers being employed in the delivery of food.

* * * * *